US008839882B2

(12) United States Patent
Finkenzeller

(10) Patent No.: US 8,839,882 B2
(45) Date of Patent: Sep. 23, 2014

(54) DRILLING DEVICE AND DRILLING METHOD

(75) Inventor: Stefan Michael Finkenzeller, Reichertshofeg (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 595 days.

(21) Appl. No.: 13/109,396

(22) Filed: May 17, 2011

(65) Prior Publication Data

US 2012/0012390 A1 Jan. 19, 2012

(30) Foreign Application Priority Data

Jul. 16, 2010 (EP) ..... 10007405

(51) Int. Cl.
*E21B 7/00* (2006.01)
*E21B 7/20* (2006.01)
*E02D 5/38* (2006.01)

(52) U.S. Cl.
CPC .. *E21B 7/20* (2013.01); *E02D 5/385* (2013.01)
USPC ..... 175/88; 175/207; 175/209; 405/228; 405/232; 405/257

(58) Field of Classification Search
USPC ..... 405/257, 232, 228, 249; 175/84, 88, 175/207, 209, 308; 166/162
See application file for complete search history.

(56) References Cited

U.S. PATENT DOCUMENTS

| | | | | |
|---|---|---|---|---|
| RE21,506 | E * | 7/1940 | Satre, H.E. | 175/88 |
| 2,631,013 | A | 3/1953 | Darin | |
| 2,743,904 | A | 5/1956 | Scott | |
| 2,873,950 | A | 2/1959 | Thorne | |
| 3,894,400 | A * | 7/1975 | Stillwell et al. | 175/88 |
| 6,540,443 | B2 * | 4/2003 | Kato et al. | 405/232 |
| 2003/0094308 | A1 | 5/2003 | Weixler | |

FOREIGN PATENT DOCUMENTS

| | | | |
|---|---|---|---|
| CN | 1417448 | A | 5/2003 |
| CN | 2591104 | Y | 12/2003 |
| CN | 201027491 | Y | 2/2008 |
| DE | 3440727 | A1 | 5/1986 |
| DE | 10155105 | C1 | 4/2003 |
| JP | H5-73094 | U | 10/1993 |
| JP | 2001-27086 | A | 1/2001 |
| JP | 2001-317282 | A | 11/2001 |
| JP | 2003-193875 | A | 7/2003 |
| JP | 2011-47269 | A | 3/2011 |

OTHER PUBLICATIONS

M.Georgescu; European Search Report; EP10007405; Jan. 13, 2011.

* cited by examiner

*Primary Examiner* — Sean Andrish
(74) *Attorney, Agent, or Firm* — Studebaker & Brackett PC

(57) ABSTRACT

The invention relates to a drilling device and a drilling method for drilling inside a casing tube, wherein the drilling apparatus has a supporting frame with a fastening means for fixation with respect to the casing tube and a drilling tool, which is driven in a rotating manner via a telescopic rod by means of a drill drive arranged on the supporting frame. An emptying station for attachment to the upper end of the casing tube is provided, wherein the supporting frame of the drilling apparatus can be fastened on the emptying station. For emptying the drilling tool of drill cuttings the emptying station has an unloading means, which is adjustable for receiving the drill cuttings. The unloading means is designed for conveying the drill cuttings away from the emptying station.

12 Claims, 5 Drawing Sheets

1
2
5
7
10
20
25
30
31
34
36
37
40
50
70
100
110
140

20'
100
70
28
74
7
140
22
36
5

DRILLING DEVICE AND DRILLING METHOD

BACKGROUND

The invention relates to a drilling device with a drilling apparatus for drilling inside a casing tube, wherein the drilling apparatus has a supporting frame with a fastening means for fixation with respect to the casing tube and a drilling tool, which is driven in a rotating manner via a telescopic rod by means of a drill drive arranged on the supporting frame.

The invention further relates to a drilling method for producing a borehole inside a casing tube, wherein a supporting frame of a drilling apparatus is fixed with respect to the casing tube and, by means of a drill drive arranged on the supporting frame, a drilling tool is driven in a rotating manner via a telescopic rod, whereby soil material is removed as drill cuttings inside the casing tube and received in the drilling tool.

A drilling device and a drilling method of such type are known from EP 1 154 078 B1. For the production of a drilled pile in soft underground a casing tube is initially pressed or twisted in by means of a known introduction device. Subsequently, to remove the soil material inside the casing tube a drilling apparatus with a supporting frame is used via a crane means. To this end the supporting frame is clamped at the upper end of the casing tube. For the drilling tool use is made of a drilling bucket which is lowered by the crane means via a telescopic Kelly rod. The drilling tool of the drilling apparatus is driven in a rotating manner via the Kelly rod by a drill drive that is arranged on the clamped supporting frame.

As soon as the receiving space of the drilling bucket is filled with removed soil material, the drilling tool is lifted again by the crane means. Afterwards, the supporting frame is detached from the casing tube and the entire drilling apparatus is swung laterally with respect to the casing tube. In this position the drilling bucket is emptied.

In order to continue the drilling process the drilling apparatus is then placed onto the casing tube again, the supporting frame is clamped thereto and the drilling apparatus is lowered once more.

On completion of the drilling process the drilling apparatus is removed in its entirety using the crane means and the cavity developed inside the casing tube can be filled for example by inserting a reinforcement cage made of steel and a concrete mass for producing a foundation pile.

All in all, this drilling method is very economical because on completion of drilling the drilling apparatus can be moved by the crane means to another casing tube so that the next drilling process can be commenced immediately afterwards. Due to the fact that the drilling apparatus can be moved in a quick and efficient way via a cable suspension on a crane means, a "flying drilling apparatus", so to speak, is created.

In the case of unfavorable weather conditions, for example in the case of poor visibility or strong winds, the placing of the drilling apparatus onto the casing tube and the clamping of the supporting frame call for a high degree of experience and skill of the operator inside the crane means. Swaying movements of the drilling apparatus suspended on the crane cable can give rise to delays in the work process.

SUMMARY

An embodiment of the present disclosure is to provide a drilling device and a drilling method, which enable an efficient production of a borehole in a casing tube even under adverse weather conditions.

The drilling device according to the invention is characterized in that an emptying station for attachment to the upper end of the casing tube is provided, wherein the supporting frame of the drilling apparatus can be fastened on the emptying station, in that in order to empty the drilling tool of drill cuttings the emptying station has an unloading means which is adjustable for receiving the drill cuttings and in that the unloading means is designed for conveying the drill cuttings away from the emptying station.

A fundamental idea of the invention resides in the fact that during the production of the borehole the drilling apparatus no longer has to be detached from the casing tube for example for emptying the drilling tool or when carrying out measuring or maintenance operations. For this reason, the drilling apparatus is connected to an emptying station attached to the upper end of the casing tube. The emptying station can be connected to the casing tube by means of a releasable fastening mechanism. The drilling apparatus can be moved axially with respect to the casing tube into the emptying station in a holding position. In this position the drilling tool can be emptied via an unloading means integrated into the emptying station, in which case the unloading means is brought into a position for conveying the drill cuttings away.

As a result, the work process is facilitated in its entirety, since a repeated detachment and renewed adjustment and fastening of the supporting frame is omitted. This enables work operations that are largely independent of weather influences. In this way the drilling device according to the invention can also be employed e.g. in offshore regions for the production of foundation piles in ocean beds. Strong coastal winds as well as swaying movements of a crane means arranged on a water vehicle therefore have hardly any bearing on the work process.

Basically, various kinds of drilling tools can be used on the drilling apparatus. According to the invention, discontinuously operating drilling tools, including augers that twist themselves into the soil, are especially advantageous. For work operations carried out in soft soil types or under water it is of advantage in accordance with the invention that the drilling tool is designed as a drilling bucket with a bottom which can be hinged open for emptying the drilling bucket.

A further development in accordance with the invention resides in the fact that the unloading means has an actuation member, through which the bottom of the drilling bucket is opened or closed during adjustment of the unloading means into and/or out of the unloading position. In a known manner the hinged bottom has, in the first instance, an opening with cutting means so that soil material can be removed and conveyed through the opening into the cylindrical receiving space of the drilling bucket. In certain embodiments a screw can be arranged as an additional conveyor means inside the drilling bucket. When the receiving space is filled the opening is closed through a twisting movement of the bottom so that the drilling bucket with the removed soil material is withdrawn from the casing tube into the emptying station. Afterwards, the unloading means is brought into a position provided for emptying and in doing so the bottom of the drilling bucket can be hinged open via the actuation member and emptied. This can be realized, for example, in that through adjustment of the unloading means the drilling bucket is moved against a stop and as a result the bottom of the drilling bucket opens through actuation of a latch mechanism. As soon as the drill cuttings of the drilling bucket have been received or conveyed away by the unloading means, a hinged-open bottom of the drilling bucket can be closed again through adjustment of the unloading means from out of the unloading position. For instance the unloading means could have a ramp-shaped positioning element as an actuation member, which, by carrying out a displacement movement, pushes the hinged-open bottom back into its closed position, whereby the lock of the bottom is latched again. After this, the drilling tool can be lowered again by the telescopic rod into the casing tube and the drilling operation can be continued.

Basically, various types of unloading means can be integrated into the emptying station. For instance the unloading means can be designed as an adjustable conveyor belt on which removed drill cuttings can be transported away. Use could also be made of a suction means with which the drill cuttings are sucked off from the drilling tool.

However, in accordance with the invention it is especially preferred that the unloading means has a chute which is pivotable about a pivot axis into an inclined position. The chute can be mounted e.g. laterally near the drilling axis on the emptying station such that it can be brought into an inclined position underneath the drilling tool and receive the drill cuttings in this position.

Another preferred embodiment of the invention results from the fact that the chute is pivotable about the pivot axis between a retracted position and the unloading position and that in the unloading position the chute is in the inclined position, in which the drill cuttings can be led out of the emptying station. The chute can be located e.g. in a mounting near the casing tube. In the retracted position the surface of the chute can be supported approximately parallel to the casing tube. In this way the drilling tool can be moved unobstructed along the drilling axis. As soon as the drilling tool has been moved after a drilling step out of the casing tube and into the emptying station the chute can be adjusted into an unloading position, in which it is located in an inclined position underneath the drilling tool. The adjusting process can be realized, for example, in that at its lower edge the chute is connected via a rotary joint to the emptying station and is pivoted via this rotary joint into an inclined position underneath the drilling tool.

Another preferred embodiment of the invention results from the fact that the unloading means has a conveyor carriage which is movable along a path between the unloading position and a conveying position for conveying the drill cuttings away from the emptying station. The conveyor carriage could be movable, for example, via rollers along a rail between the unloading position and a conveying position, in which case the drive of the carriage can be realized in various ways. For example the carriage could have its own motor, by means of which it can drive itself. However, other types of drive would also be possible, in which the carriage is pulled with hoist winch and rope or, in the case of short distances, is moved via a hydraulic cylinder along the path. The energy required for actuation can either be derived from the drilling apparatus or provided by an independent energy supply of the emptying station. The conveyor carriage is designed with a loading space, with which the drill cuttings can be received from the drilling tool when the carriage is located in the unloading position. The loading space could be realized, for example, in the form of a tipping trough, with which the drill cuttings can be tipped from the emptying station as soon as the conveyor carriage is located in the conveying position. Alternatively, the loading space of the conveyor carriage can also have a hinged bottom, through which the drill cuttings are tipped downwards in the conveying position. The tipped material could then be received by a disposal system located next to the emptying station. This could, for example, be a container, a truck, a conveyor belt, a transport vessel etc.

According to the invention it is preferred that the emptying station has a coupling means for fastening on the casing tube and a platform which is adjustable by means of an adjusting means with respect to the coupling means. Through suitable fastening means, such as clamping claws, the coupling means is detachably connected to the casing tube. The platform attached to the coupling means can be adjusted by the adjusting means in a variety of ways with respect to the opening of the casing tube. As a result, for example, the platform can be angled with respect to the casing tube. For instance in the case of inclined drilling with respect to the vertical the platform can still be brought into a horizontal position. Likewise, a raising of the platform with respect to the casing tube could also be realized in this way. An adjusting means of such type can also be considered as an independent idea of the invention without the aforementioned features or only with a part thereof and can be employed with other mounting devices on casing tubes.

With regard to the drilling method the invention is characterized in that the supporting frame of the drilling apparatus is fastened on an emptying station, which is arranged at an upper end of the casing tube, that for unloading the drill cuttings from the drilling tool this is moved out of the casing tube into the emptying station, that an unloading means on the emptying station is adjusted into an unloading position for receiving the drill cuttings from the drilling tool and that through the unloading means the drill cuttings are conveyed away from the emptying station.

As set out beforehand, due to the emptying station according to the invention a speed-up and simplification of the work process is achieved.

According to the invention a preferred procedure resides in the fact that through movement of the drilling tool, designed as a drilling bucket with hinged bottom, into the emptying station against a stop the bottom of the drilling bucket is opened for emptying. The drilling bucket could also activate a latch mechanism through a rotation, in which the bottom of the drilling bucket is opened for emptying.

Another preferred embodiment of the invention resides in the fact that in the unloading position for receiving the drill cuttings the unloading means is arranged underneath the drilling tool. This unloading position of the unloading means has the advantage that the unloading process mainly takes place through gravity so that normally no further active systems need to be employed for emptying the drilling tool.

Furthermore, in accordance with the invention it can be of advantage that the unloading means has a chute, which is pivoted about a pivot axis into an inclined position in the unloading position and that via the inclined chute drill cuttings are led out of the emptying station. The chute can be brought into the unloading position in various ways. For example, it is possible that the chute is folded out or moved from a resting position into the unloading position or that it is rotated with respect to an axis lying parallel to the longitudinal side of the casing tube into the unloading position. The conveyance of the drill cuttings is brought about through the inclined position of the chute with respect to the horizontal.

A particular embodiment of the invention is provided in that the unloading means has a conveyor carriage which is moved along a path between the unloading position and a conveying position, that in the unloading position the drill cuttings are emptied from the drilling tool into the conveyor carriage and that in the conveying position the drill cuttings are conveyed away from the emptying station by the conveyor carriage. By way of the aforementioned types of drive the conveyor carriage is moved along the path between the unloading position and the conveying position. The movement of the conveyor carriage and the reception or conveyance of the drill cuttings can be controlled both automatically and manually.

Furthermore, according to the invention provision is made that during adjustment of the unloading means into and/or out of the unloading position a bottom of a drilling bucket, which is used as a drilling tool, is opened or closed. The latch mechanism of the bottom of the drilling bucket could be activated, for example, in that the chute or the loading space of the conveyor carriage is moved along the bottom of the drilling bucket and in doing so the bottom is opened or closed.

According to the invention another preferred procedure resides in the fact that the emptying station is fastened with a coupling means on the casing tube and that a platform of the emptying station is adjusted by means of an adjusting means with respect to the coupling means. The adjusting means assumes the task of setting the position of the platform with respect to the casing tube in such a manner that favorable conditions are created for the drilling method. In this way, different angles between the platform and the transverse axis of the casing tube could be set by way of one or more positioning cylinders for example. Likewise, displacements of the platform in the horizontal or vertical plane could be set, too.

Furthermore, according to the invention provision is made for the casing tube to be introduced, in particular pressed into the soil. For this purpose a known pushing device can be employed. In addition, it is in accordance with the invention that the emptying station is fastened in a detachable manner on the casing tube and that subsequently a concrete mass is filled into the produced borehole in the casing tube and a drilled pile is formed.

According to a further aspect of the invention this comprises an emptying station with a coupling means for fastening on a casing tube, a receiving section for receiving and retaining a drilling apparatus with drilling tool and an unloading means for emptying the drilling tool and for receiving drill cuttings from the drilling tool, wherein the unloading means is designed for conveying the drill cuttings away from the emptying station. The emptying station can be used, in particular, for the afore-described drilling device and the aforementioned drilling method so that the advantages set out in conjunction therewith can be achieved.

BRIEF DESCRIPTION OF THE DRAWINGS

In the following the invention will be described further by way of preferred embodiments illustrated schematically in the drawings, wherein show.

DETAILED DESCRIPTION

Figure 1:
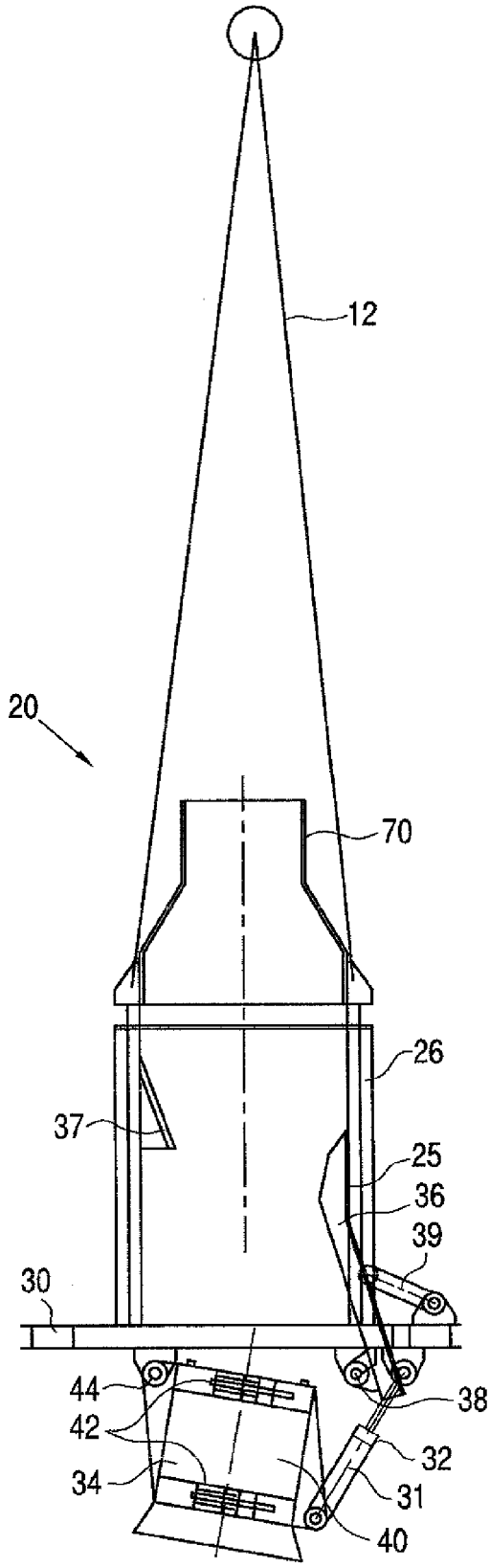
FIG. 1 is a schematic side view of a first emptying station according to the invention.

A first emptying station 20 pursuant to the invention as depicted in accordance with FIG. 1 has a platform 30 constructed of steel profiles. On the underside of the platform 30 a coupling means 34 for detachable fastening on a casing tube 5 is arranged. The coupling means 34 comprises a sleeve body 40 with a conical widening located below, the inner diameter of which can be narrowed by hydraulic clamping cylinders 42. In this way, the sleeve body 40 can be placed on the outer periphery of the casing tube 5 and connected thereto in a force-fitting manner.

Via a pivot joint 44 the sleeve-shaped body 40 is supported in a pivotable manner about an approximately horizontal axis on the platform 30. With a pivoting cylinder 32 arranged on the opposite side an adjusting means 31 is formed, with which the platform 30 can be positioned at an angle via the pivot joint 44 with respect to the coupling means 34.

On the upper side of the platform 30 a frame 26 is formed by means of vertical supports, on the upper side of which a sleeve-shaped receiving part 70 is arranged. The sleeve-shaped receiving part 70 has approximately the diameter of the casing tube 5, to which the emptying station 20 is to be attached. The sleeve-shaped receiving part 70 serves for fastening a drilling apparatus, which is described in the following in conjunction with FIG. 5.

Furthermore, according to the invention an unloading means 25 is provided on the platform 30. In the present embodiment this unloading means has a chute 36 which is pivotable via a pivot axis 38 by means of a positioning cylinder 39 between the illustrated retracted position and an unloading position.

Moreover, on the frame 26 a stop 37 is arranged which serves for actuation of the drilling apparatus. Furthermore, a crane suspension 12 is arranged so that the emptying station 20 can be transported by means of a crane to and from the casing tube 5.

Figures 2A, 2B, 2C, 2D, 2E, 2F, 2G, 2H:
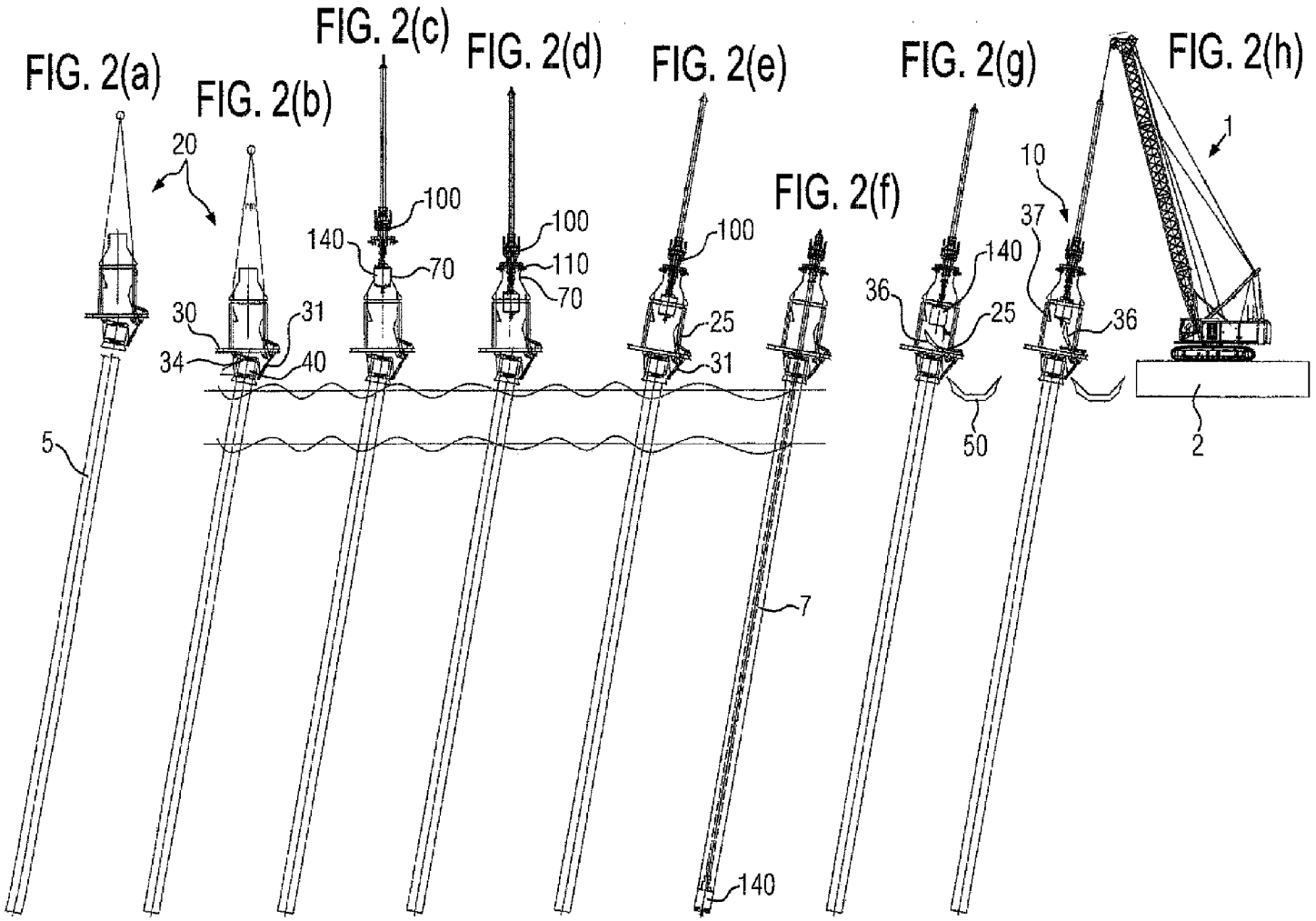
FIG. 2(*a*) through FIG. 2(*h*) are schematic side views during the implementation of the drilling method according to the invention with the emptying station according to FIG. 1.

According to FIGS. 2(*a*)-2(*h*) an exemplary drilling method in accordance with the invention is shown schematically by way of eight work steps, which are sequentially shown as FIGS. 2(*a*), 2(*b*), 2(*c*), 2(*d*), 2(*e*), 2(*f*), 2(*g*) and 2(*h*). Initially, a casing tube 5, which can also be referred to as support or drilling tube, is driven in a known manner by vibrators, impact driving systems or pressing systems into a soft soil. In the illustrated embodiment the casing tube 5 is introduced into the bed of a body of water at an inclined angle to the vertical. By means of a crane 1, which is arranged on a pontoon 2 for operation on bodies of water, the emptying station 20 according to FIG. 1 is transported to the upper side of the casing tube 5 (step 1 shown in FIG. 2(*a*)). According to work step 2 as shown in FIG. 2(*b*), the coupling means 34 with an enlarged diameter is placed on. Through tightening of the clamping cylinders 42 a force-fitting connection of the coupling means 34 with the upper end of the casing tube 5 is brought about. In doing so, the adjusting means 31 is set in such a way that the platform 30 of the emptying station 20 assumes a horizontal position, while the sleeve body 40 is arranged coaxially to the longitudinal axis of the casing tube 5.

Subsequently, according to step 3 as shown in FIG. 2(*c*) a drilling apparatus 100 with a drilling bucket serving as drill tool 140 is placed into the cylindrical receiving part 70. The drilling apparatus 100 will be described in the following in greater detail in conjunction with FIG. 5.

According to work step 4 as shown in FIG. 2(*d*), the drilling apparatus 100 is clamped via its supporting frame 110 to the upper edge of the cylindrical receiving part 70 so that henceforth a fixed connection to the casing tube 5 is present via the emptying station 20 with the coupling means 34.

Afterwards, according to work step 5 as shown in FIG. 2(*e*) the adjusting means 31 is adjusted in such a way that the drilling apparatus 100 is brought from its vertical position into an inclined position, in which the axis of the drilling apparatus 100 is aligned with the longitudinal axis of the casing tube 5. During these work steps the unloading means 25 is located in the illustrated retracted position which permits free passage of the drilling tool 140 of the drilling apparatus 100 through the emptying station 20 into the interior of the casing tube 5 for the removal of soil material.

According to work step 6 as shown in FIG. 2(*f*) the deepest and therefore final drilling step at the lower end of the casing tube 5 is already shown. As soon as the drilling tool 140 designed as a drilling bucket is filled with removed soil material inside the casing tube 5, the telescopic Kelly rod 7 is retracted again by the crane 1 until the drilling tool 140 is arranged in a desired holding position in the emptying station 20 according to work step 7 shown in FIG. 2(*g*). A chute 36 of the unloading means 25 can henceforth be pivoted into an unloading position according to work step 7. By opening the drilling tool 140 drill cuttings can henceforth be carried away from the drilling tool 140. These drill cuttings are led off via the inclined chute 36 through the effect of gravity directly outside the emptying station 20 to a conveyor means 50. The conveyor means 50 can be a transport vessel. Through a twisting movement of the drilling tool 140 and assisted by a stop 37 as well as by the retracting movement of the chute 36 the drilling tool 140 can be closed again, as shown in work step 8 of FIG. 2(*h*). Afterwards, the drilling tool 140 could be lowered again into the casing tube 5 for carrying out a further drilling step.

After the borehole has been sunk to the desired final depth the drilling tool 140 is retracted again and the drilling device 10 with the emptying station 20 and the drilling apparatus 100 can be removed from the casing tube 5. The cavity of the casing tube 5 can then be filled with reinforcing steel and concrete mass for forming a drilled pile. During the filling process the casing tube 5 can be extracted and reused where necessary. Alternatively, the casing tube 5 can also remain in the ground so that a drilled pile with casing is formed.

Figure 3:
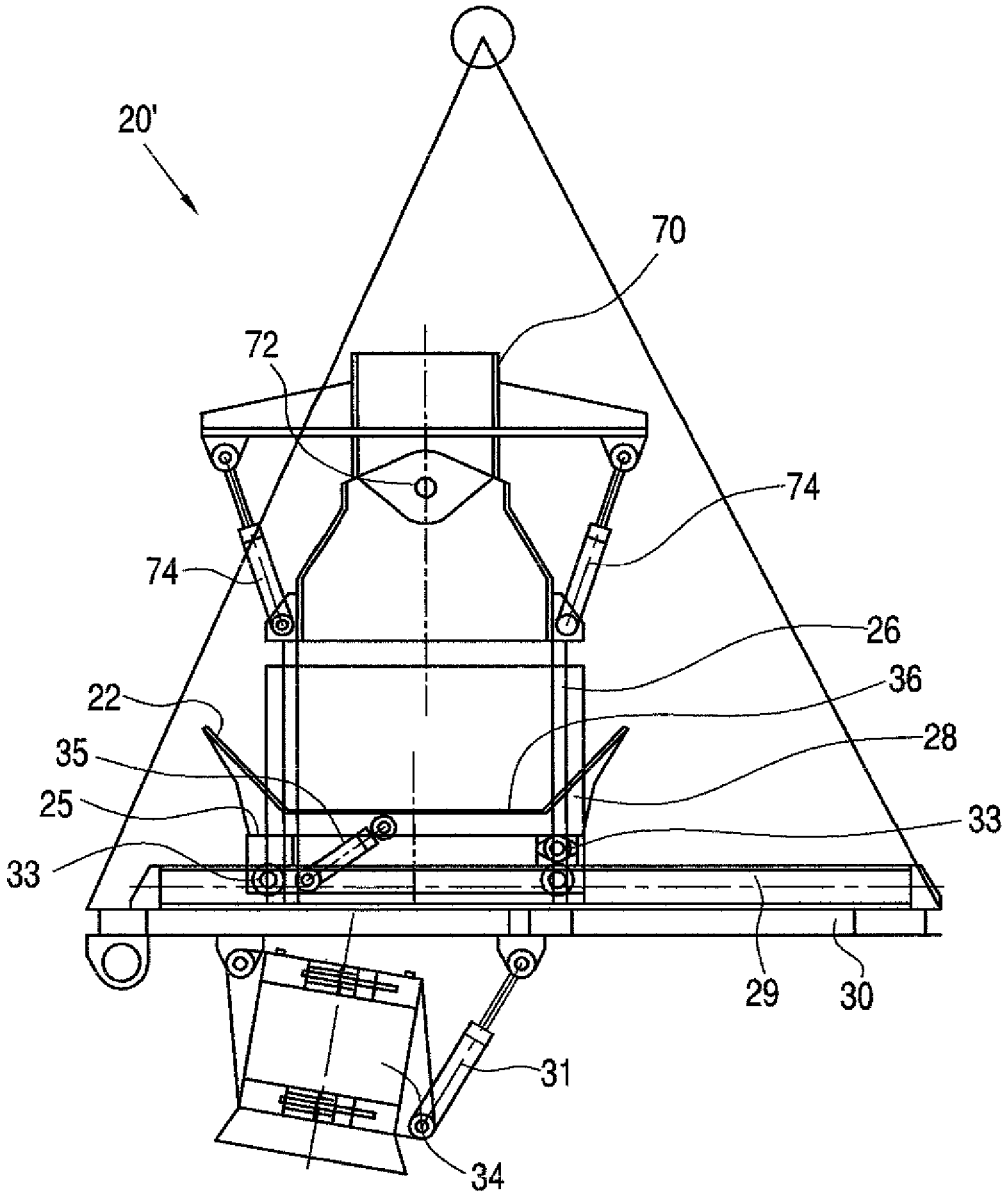
FIG. 3 is a schematic side view of a second emptying station according to the invention.

According to FIG. 3 a second emptying station 20' is shown. This also has a platform 30 with a coupling means 34, as described in connection with the emptying station 20 of FIG. 1. Furthermore, on the upper side of the platform 30 a frame 26 with a cylindrical receiving part 70 for the fastening of a drilling apparatus is provided.

In contrast to the emptying station 20 according to FIG. 1 the sleeve-shaped receiving part 70 of the emptying station 20' of FIG. 3 is pivotably supported about an axis 72 on the frame 26. The pivoting movement of the sleeve-shaped receiving part 70 takes place by means of two lateral pivoting cylinders 74 so that through the pivoting capacity of the receiving part 70 the pivoting movement of the adjusting means 31 for the purpose of aligning the emptying station 20 with respect to a possibly inclined casing tube is improved.

Moreover, in contrast to the emptying station 20 according to FIG. 1 a modified unloading means 25 is provided.

The unloading means 25 according to FIG. 3 comprises a conveyor carriage 28, which is movable along a path 29 formed by rails on the platform 30 between the depicted unloading position and an outward lying conveying position. To this end the conveyor carriage 28 has rollers 33 located at its underside. Furthermore, the receiving area of the conveyor carriage 28 is designed as a chute 36 which can be actuated by means of an adjusting cylinder 35.

Figures 4A, 4B, 4C, 4D, 4E, 4F, 4G, 4H:
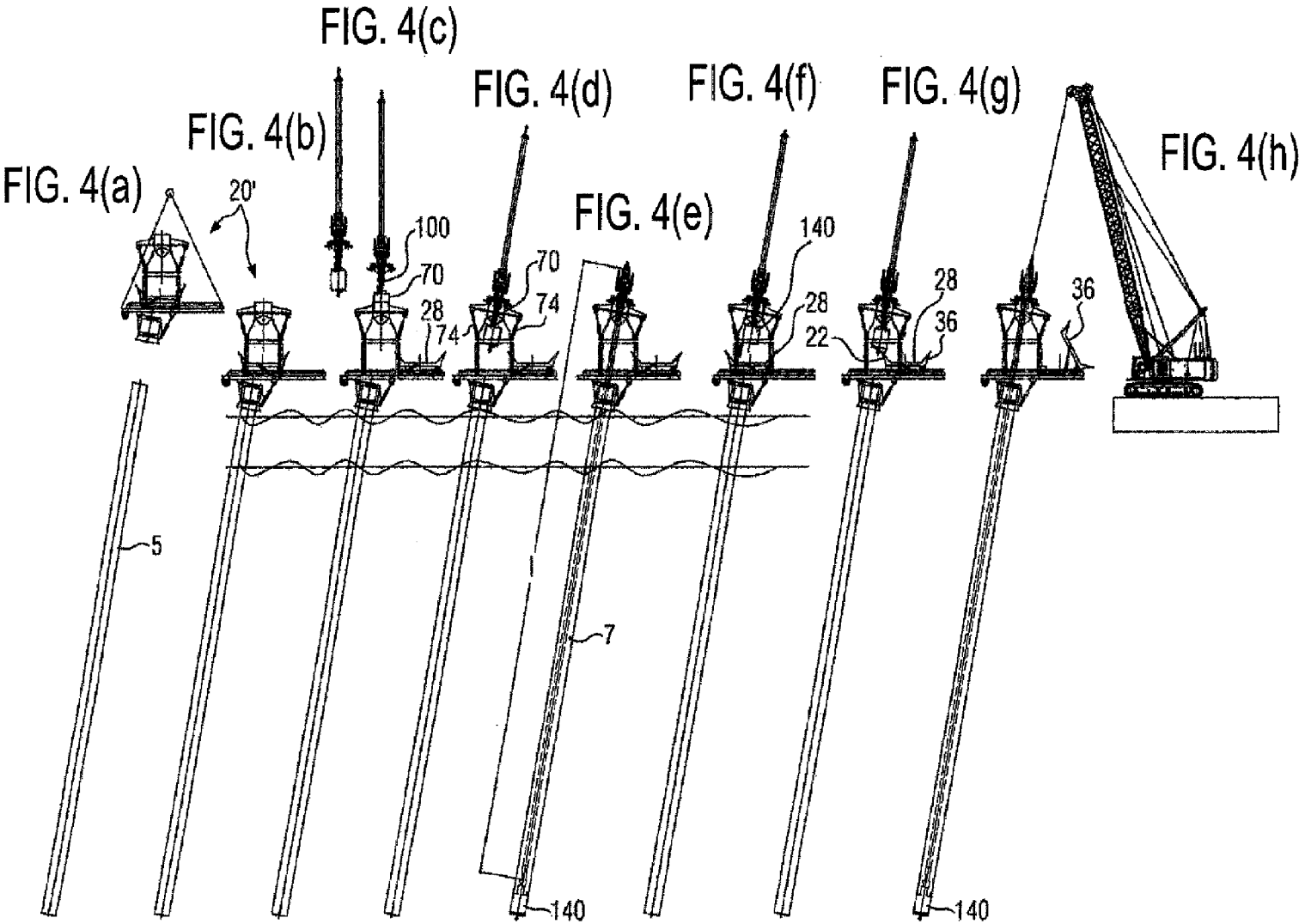
FIG. 4(*a*) through FIG. 4(*h*) are schematic side views of a further drilling method according to the invention with an emptying station according to FIG. 3.

Similar to FIGS. 2(*a*)-2(*h*), FIGS. 4(*a*)-4(*h*) show a further drilling method according to the invention in eight work steps with the emptying station 20' of FIG. 3.

In line with the drilling method according to FIGS. 2(*a*)-2(*h*) the emptying station 20' is fastened on the casing tube 5. Afterwards, the drilling apparatus 100 is coupled to the cylindrical receiving part 70. Furthermore, the conveyor carriage 28 is moved into an outward lying retracted position according to work step 3 shown in FIG. 4(*c*).

As can be taken from work step 4 shown in FIG. 4(*d*), through actuation of the pivoting cylinders 74 the vertically directed cylindrical receiving part 70 is angled and orientated so as to be aligned with the axis of the casing tube 5. After that, the drilling tool 140 of the drilling apparatus 100 can be sunk in several drilling steps according to the maximum length L of the Kelly rod 7, as depicted in work step 5 shown in FIG. 4(*e*).

According to work step 6 shown in FIG. 4(*f*), after each drilling step the drilling tool 140, when being filled, is moved back into the emptying station 20'. Then the conveyor carriage 28 is moved into the unloading position underneath the drilling tool 140 and at the same time or subsequently the drilling tool 140 is opened and the drill cuttings are unloaded from the drilling tool 140 into the conveyor carriage 28. According to work step 7 shown in FIG. 4(*g*), the conveyor carriage 28 is moved into a conveying position outside the emptying station 20' and at the same time a hinged bottom of the drilling tool 140 is closed by an actuation member 22 on the conveyor carriage 28. In the conveying position a chute 36 of the conveyor carriage 28 is tilted so that the drill cuttings are removed from the chute 36. Afterwards, according to work step 8 shown in FIG. 4(*h*) a further drilling step can be carried out with the drilling tool 140.

Figure 5:
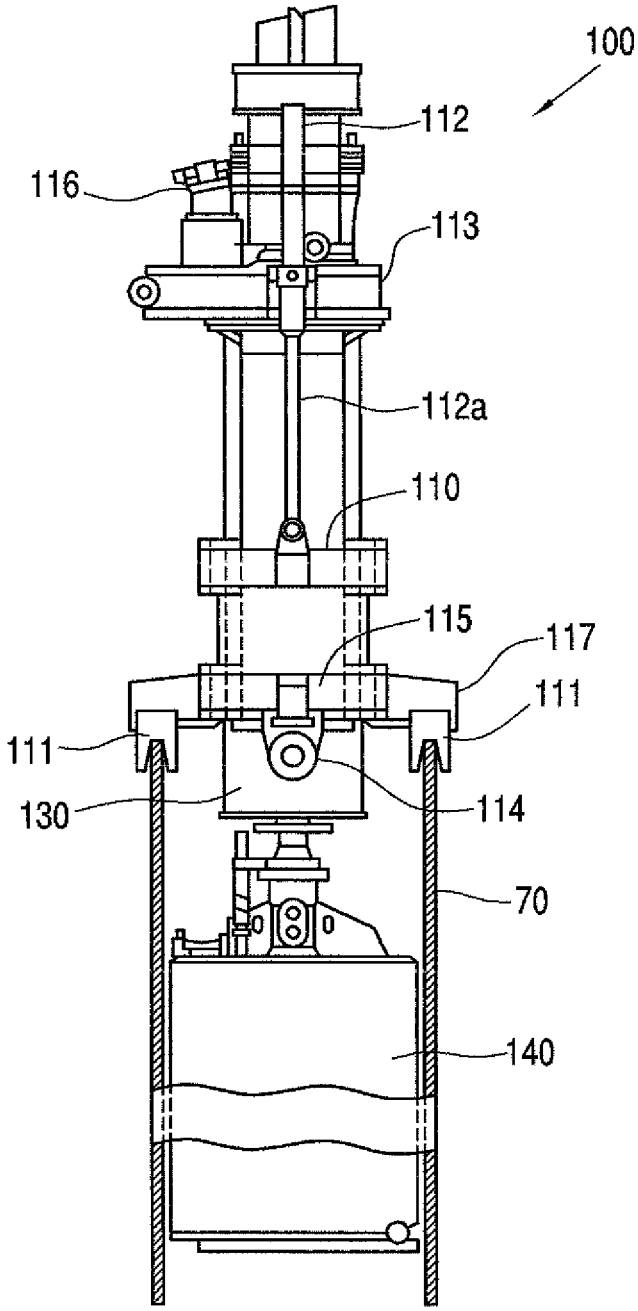
FIG. 5 is a schematic part cross-sectional view of a drilling apparatus according to the invention.

A preferred drilling apparatus 100 is shown in FIG. 5. The drilling apparatus 100 has a supporting frame 110 which is provided with cross members 117 at its lower end. At the underside of the cross members 117 placing brackets 111 are arranged on the one hand, with which the drilling apparatus 100 can be placed onto an upper edge of the sleeve-shaped receiving part 70 of the emptying station 20. Located offset to the placing brackets 111 one or more fastening means 114 are provided that have hydraulically actuated collets. With these collets the supporting frame 110 can be fastened in a rotationally fixed manner on the receiving part 70.

Furthermore, also arranged on the supporting frame 110 is a drill drive 116 for driving the drilling tool 140 in a rotating manner via a telescopic rod 130.

In the illustrated embodiment the supporting frame 110 is of a two-part design with a lower supporting frame part 115 and an upper supporting frame part 113 arranged above. On the upper supporting frame part 113, which is axially adjustable with respect to the lower supporting frame part 115 by means of hydraulic cylinders 112 with hydraulic cylinder pistons 112*a*, the drill drive 116 is arranged in a fixed manner.

By releasing the fastening means 114 the drilling apparatus 100 can be pulled upwards out of the receiving part 70 and then placed onto a receiving part of another emptying station in order to produce a further borehole.

The invention claimed is:

1. A drilling device with a drilling apparatus for drilling inside a casing tube, wherein the drilling apparatus has a supporting frame with fastening means for fixation with respect to the casing tube and a drilling tool, which is driven in a rotating manner via a telescopic rod by means of a drill drive arranged on the supporting frame, wherein an emptying station for attachment to the upper end of the casing tube is provided, wherein the supporting frame of the drilling apparatus is capable of being fastened on the emptying station, in order to empty the drilling tool of drill cuttings the emptying station has an unloading means which is adjustable for receiving the drill cuttings, the unloading means being designed for conveying the drill cuttings away from the emptying station, wherein the unloading means has a chute which is pivotable about a pivot axis into an inclined position, and wherein the drilling tool is configured as a drilling bucket with a bottom which is hinged open for emptying the drilling bucket.

2. The drilling device according to claim 1, wherein the unloading means has an actuation member, by which the bottom of the drilling bucket is opened or closed during adjustment of the unloading means into or out of an unloading position.

3. The drilling device according to claim 1, wherein the chute is pivotable about the pivot axis between a retracted position and the unloading position, and in the unloading position the chute is in the inclined position, in which the drill cuttings are led out of the emptying station.

4. The drilling device according to claim 1, wherein the unloading means has a conveyor carriage which is movable along a path between an unloading position and a conveying position for conveying the drill cuttings away from the emptying station.

5. The drilling device according to claim 1, wherein the emptying station has coupling means for fastening the emptying station on the casing tube and a platform, which is adjustable by means of adjusting means with respect to the coupling means.

6. A drilling method for producing a borehole inside a casing tube, utilizing the drilling device according to claim 1, wherein the supporting frame of the drilling apparatus is fixed with respect to the casing tube and, by means of the drill drive arranged on the supporting frame, the drilling tool is driven in a rotating manner via the telescopic rod, whereby soil material is removed as drill cuttings inside the casing tube and received in the drilling tool, the method comprising:

fastening the supporting frame of the drilling apparatus on an emptying station, which is arranged at an upper end of the casing tube, unloading the drill cuttings from the drilling tool, wherein the soil material is moved out of the casing tube into the emptying station, adjusting the unloading means on the emptying station into an unloading position to receive the drill cuttings from the drilling tool, and using the unloading means to convey the drill cuttings from the emptying station.

7. The drilling method according to claim 6, further includes opening the bottom of the drilling bucket for emptying, by movement of the drilling tool configured as a drilling bucket with hinged bottom, into the emptying station against a stop.

8. The drilling method according to claim 6, further includes providing the unloading means with a chute, which is pivoted about a pivot axis into an inclined position in the unloading position, and unloading the drill cuttings via the inclined chute of the emptying station.

9. The drilling method according to claim 6, further includes providing the unloading means with a conveyor carriage which is moved along a path between the unloading position and a conveying position, in the unloading position, emptying the drill cuttings from the drilling tool into the conveyor carriage, and in the conveying position, conveying away the drill cuttings from the emptying station by the conveyor carriage.

10. The drilling method according to claim 6, further includes during adjustment of the unloading means into or out of the unloading position, opening or closing a bottom of a drilling bucket, which is used as a drilling tool.

11. The drilling method according to claim 6, further includes fastening the emptying station with coupling means on the casing tube, and adjusting a platform of the emptying station by means of an adjusting means with respect to the coupling means.

12. The drilling method according to claim 6, further includes introducing the casing tube into the soil, fastening the emptying station in a detachable manner on the casing tube, and subsequently filling a concrete mass into the produced borehole in the casing tube to form a drilled pile.

* * * * *

UNITED STATES PATENT AND TRADEMARK OFFICE

CERTIFICATE OF CORRECTION

PATENT NO. : 8,839,882 B2
APPLICATION NO. : 13/109396
DATED : September 23, 2014
INVENTOR(S) : Stefan Michael Finkenzeller It is certified that error appears in the above-identified patent and that said Letters Patent is hereby corrected as shown below:

On the Title Page

Item (75) should read:

-- (75) Inventor: Stefan Michael Finkenzeller,
Reichertshofen (DE) --

Signed and Sealed this
Twenty-seventh Day of January, 2015

Michelle K. Lee

Michelle K. Lee
*Deputy Director of the United States Patent and Trademark Office*